US005079782A

United States Patent [19]

Sim

[11] Patent Number: 5,079,782

[45] Date of Patent: Jan. 14, 1992

[54] TOILET ASSEMBLY

[76] Inventor: Jae K. Sim, 619 S. Orange Dr., Los Angeles, Calif. 90036

[21] Appl. No.: 541,740

[22] Filed: Jun. 21, 1990

[51] Int. Cl.[5] ..... E03D 9/05

[52] U.S. Cl. ..... 4/216

[58] Field of Search ..... 4/347-352, 4/213, 216, 217

[56] References Cited

U.S. PATENT DOCUMENTS

| | | | |
|---|---|---|---|
| 2,228,920 | 1/1941 | Baither | 4/213 |
| 2,297,935 | 10/1942 | Baither | 4/213 |
| 2,329,221 | 9/1943 | Sanford | 4/213 |
| 2,443,705 | 6/1948 | Fitzgerald | 4/213 |
| 2,487,682 | 8/1958 | Shay | 4/213 |
| 2,575,778 | 11/1951 | Wilson | 4/213 |
| 2,817,099 | 12/1957 | Fitzgerald | 4/215 |
| 3,122,757 | 3/1964 | Sowards | 4/213 |
| 3,495,282 | 2/1970 | Taggart | 4/213 |
| 3,805,304 | 4/1974 | Ikehata | 4/72 |
| 4,222,129 | 9/1980 | Baker | 4/213 |
| 4,232,406 | 11/1980 | Beeghly et al. | 4/213 |
| 4,318,192 | 3/1982 | Williams et al. | 4/213 |
| 4,365,361 | 12/1982 | Sanstrom | 4/213 |
| 4,494,255 | 1/1985 | Drummond | 4/213 |
| 4,864,664 | 9/1989 | Higgins | 4/213 |

*Primary Examiner*—Charles E. Phillips

*Attorney, Agent, or Firm*—Birch, Stewart, Kolasch & Birch

[57] ABSTRACT

A toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the the ventilation conduit, a toilet holding tank having a motion sensor disposed on the front exterior of the toilet holding tank and free of interference from the opening and closing of a toilet seat cover, a gas exhaust duct connected to the ventilation conduit and having a raised portion disposed at the interior surface thereof for allowing exhaust gas to flow from a flush ring to the ventilation conduit and preventing the flush water from flowing into the ventilation conduit, whereby opening the toilet seat cover while the user sits on the seat ring, the motion sensor actuates the fan member allowing the objectionable odor to be ventilated and in turn, when the user stands up and flushes the toilet assembly, the motion sensor is deactivated and the flush water simultaneously discharges the waste products and associated objectionable odor directly to the sewer discharge line.

5 Claims, 1 Drawing Sheet

FIG. 1
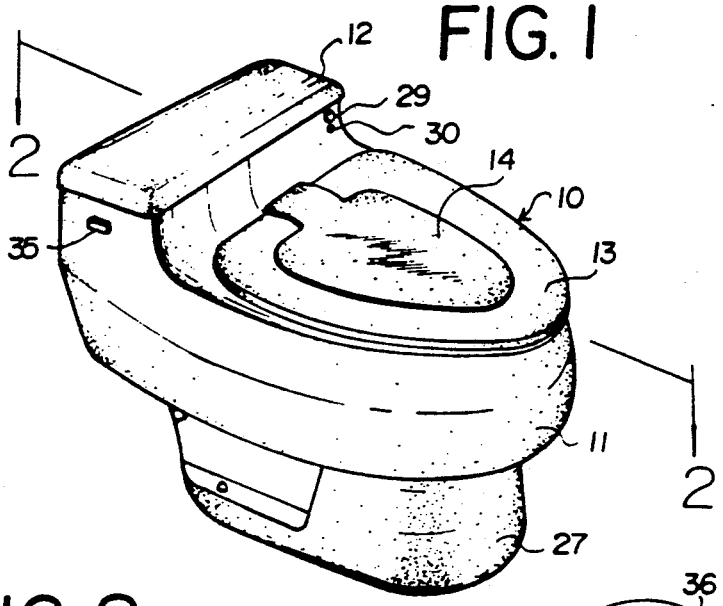
FIG. 2
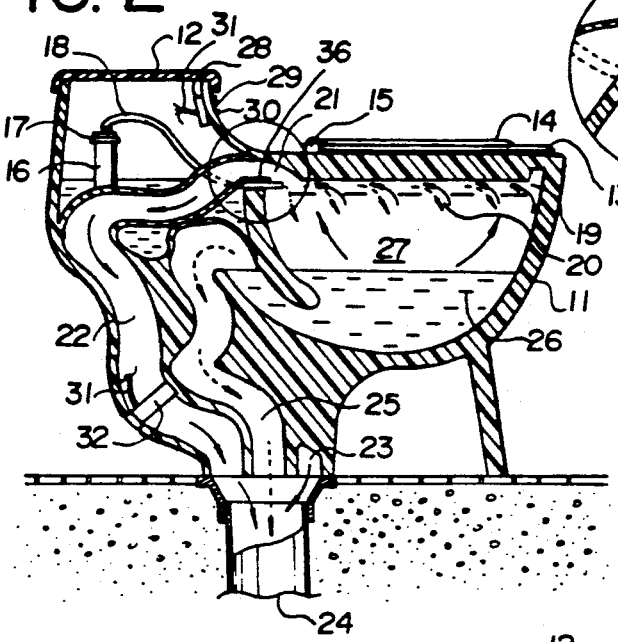
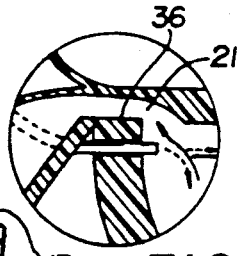
FIG. 2A
FIG. 3
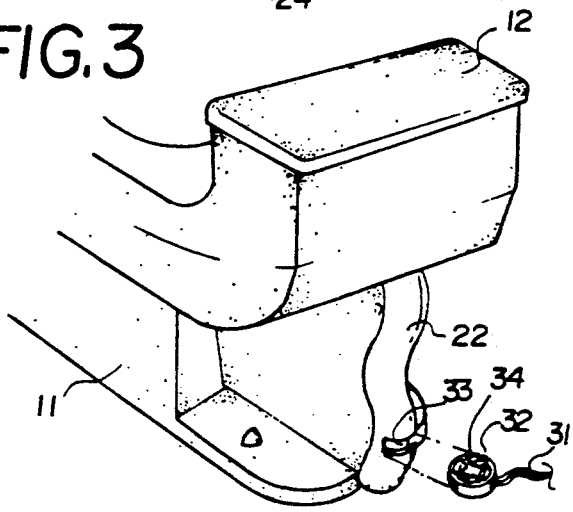

TOILET ASSEMBLY

BACKGROUND OF THE INVENTION

1. Field of the Invention

The present invention relates to a toilet assembly and more particularly, to a ventilating toilet assembly which includes a toilet stool having a ventilation conduit disposed adjacent to the back wall portion of the toilet stool for ventilating objectionable odor from the toilet bowl, the ventilation conduit extending annularly around the siphon conduit at the point where they communicate with a sewer discharge line, a fan disposed in the lower portion of the ventilation conduit, a toilet holding tank having a motion sensor disposed on the front exterior of the toilet holding tank and free of interference from the opening and closing of the toilet seat cover, a gas exhaust duct connected to the ventilation conduit and having a raised portion disposed at the interior surface thereof for allowing exhaust gas to flow from a flush ring to the ventilation conduit and preventing the flush water from flowing into the ventilation conduit from the toilet bowl whereby upon opening the toilet seat cover, while the user sits on the seat ring, the motion sensor actuates the fan following the objectionable odor is ventilated, and in turn when the user stands and flushes the toilet assembly, the motion sensor becomes inoperative and simultaneously the flush water discharges the waste product and associated objectionable odor directly to the sewer discharge line.

2. Field of the Prior Art

Various types of ventilating toilets are generally operated with a fan for ventilating a contaminated air through a separate exhaust duct. Several types of ventilating toilets are utilized with a gas exhaust duct disposed adjacent to a toilet stool and connected to a sewer discharge line or a siphon conduit. However, these toilets suffer from a number of problems such as, for example, (1) the waste product and associated objectionable odor do not clearly discharge directly to a sewer discharge line since the ventilating conduit is directly connected to the sewer discharge line or the siphon conduit, (2) the toilets are very complicated in structure, expensive to manufacture, and difficult to use, (3) since the flush water flows backward to the ventilating conduit, an amount and a water pressure of the flush water are minimized so that these toilets cannot effectively achieve the flushing purpose thereof, and (4) since such toilets are utilized with a relay type or an on/off switch for activating a fan, this switch may be out of order frequently. Furthermore, such toilets do not disclose the use of a water overflowing system and even if the system disclosed, it may be very complicated in structure and inefficient in use. Some prior toilets are described in Baither U.S. Pat. No. 2,227,920, Baither U.S. Pat. No. 2,297,935, Sanford U.S. Pat. No. 2,329,221, Fitzgerald U.S. Pat. No. 2,443,705, Wilson U.S. Pat. No. 2,575,778, Fitzgerald U.S. Pat. No. 2,817,099, Shay U.S. Pat. No. 2,847,682, Taggart U.S. Pat. No. 3,495,282, Ikehata U.S. Pat. No. 3,805,304, Baker U.S. Pat. No. 4,222,129, Beeghly et al U.S. Pat. No. 4,232,406, Williams et al U.S. Pat. No. 4,318,192, Sanstrom U.S. Pat. No. 4,365,361, Drummond U.S. Pat. No. 4,494,255, and Higgins U.S. Pat. No. 4,865,664.

SUMMARY OF THE INVENTION

Accordingly, it is an object of the present invention to provide an improved ventilating toilet assembly, whereby objectionable odor from the toilet bowl is effectively vented therefrom and discharged into a sewer discharge line.

Another object of the present invention is to provide a toilet assembly which includes a toilet stool having a ventilation conduit disposed adjacent to the back wall portion of the toilet stool for ventilating objectionable odor from the toilet bowl, the ventilation conduit extending annularly around a siphon conduit at the point where they communicate with the sewer discharge line, a fan disposed in the lower portion of the ventilation conduit, a toilet holding tank having a motion sensor disposed on the front exterior of the toilet holding tank and free of interference from the opening and closing of the toilet seat cover, a gas exhaust duct connected to the ventilation conduit and having a raised portion disposed at the interior surface thereof for allowing exhaust gas to flow from a flush ring to the ventilation conduit and preventing the flush water from flowing into the ventilation conduit from the toilet bowl, whereby upon opening the seat cover, while the user sits on the seat ring, the motion sensor actuates the fan allowing the objectionable odor to be ventilated, and in turn when the user stands and flushes the toilet assembly, the motion sensor is deactivated and simultaneously the flush water discharges the waste products and associated objectionable odor directly to the sewer discharge line.

A further object of the present invention is to provide a toilet assembly which is simple in construction, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion sensor disposed on the front exterior of the toilet holding tank and free of interference from the opening and closing of a toilet seat cover, a gas exhaust duct connected to the ventilation conduit and having a raised portion disposed at the interior surface thereof for allowing exhaust gas to flow from a flush ring to the ventilation conduit and preventing the flush water from flowing into the ventilation conduit from the toilet bowl to the whereby upon opening the toilet seat cover, while the user sits on the seat ring, the motion sensor the fan member allowing the objectionable odor to be ventilated, and in turn when the user stands and flushes the toilet assembly, the motion sensor is deactivated and simultaneously the flush water discharges the waste product and associated objectionable odor directly to the sewer discharge line.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of the toilet assembly according to the present invention;

FIG. 2 is a sectional view of FIG. 1, taken along lines 2—2 and a circle, FIG. 2A, shows an enlarged detail view of a raised portion of FIG. 2; and FIG. 3 is an exploded perspective view of a ventilation conduit disposed adjacent to the back wall portion of the toilet stool according to the present invention.

DESCRIPTION OF THE PREFERRED EMBODIMENTS

Referring now in detail to the drawings for the purpose of illustrating preferred embodiments of the present invention, the toilet assembly 10 as shown in FIGS. 1 and 2, comprises a toilet stool 11, a toilet holding tank 12, a ventilation conduit 22 disposed adjacent to the back wall portion of the toilet stool 11, a motion sensor 28 disposed on the front exterior of the toilet holding tank 12, and a gas exhaust duct 21 disposed between the toilet stool 12 and the holding tank 11 and connected to the ventilation conduit 22, and having a raised portion 36 disposed at the interior surface thereof.

As shown in FIG. 2, the toilet stool 11 includes a toilet bowl 27, a flush ring 19 disposed at the upper end of the toilet bowl 27, a plurality of openings 20 communicating with the flush ring 19 for allowing fresh flush water 26 to be flushed into the toilet bowl 27 from the flush ring 19, a seat ring 13 disposed on the flush ring 19, a small toilet seat cover 14 disposed on the peripheral inside edge of the seat ring 13 and pivotally connected to the seat ring 13 by a hinge 15, and a siphon conduit 25 connected to and communicating with the toilet bowl 27 for discharging waste products and associated objectionable odor directly from the toilet bowl 27 to a sewer discharge line 24.

As shown in FIGS. 2 and 3, the ventilation conduit 22 for ventilating objectionable odor from the toilet bowl 27 extends to an annular wide end portion 23 disposed annularly around the siphon conduit 25 at the point where they communicate with the sewer discharge line 24. And the ventilation conduit 22 contains fan 32 disposed in the lower portion thereof. Thus, since the annular wide end portion 23 disposed at the bottom end of the ventilation conduit 22 is disposed annularly around the end portion of the siphon conduit 25 and is connected directly to the sewer discharge line 24, the waste products and associated objectionable odor can be completely discharged when compared with the conventional vent toilet assemblies. The fan 32 is inserted into a groove 33 disposed in the lower portion of the ventilation conduit 22 and includes a water-proof fan motor 34 connected to an electrical source (not shown) through an electric wire 31 which is passed along the ventilation conduit 22 and connected to the motion sensor 28 and the electrical source.

As shown in FIG. 2, the toilet holding tank 11 contains the flush water 26 to be flushed into the toilet bowl 27 from the flush ring 19 of the toilet stool 11. The toilet holding tank 12 includes a water supply tube 16 connected to a water supply line (not shown) through a water intake valve (not shown) disposed at the bottom end thereof, a water outlet valve 17 disposed at the top end thereof, a water hose 18 connected to the water outlet valve 17 for allowing the flush water to be passed into the toilet bowl 27, and a flush handle 35 disposed on the side exterior of the toilet holding tank 12 for connection to the water outlet valve 17. The water supply tube 16 stands at the toilet holding tank 12.

The motion sensor 28 is disposed on the front exterior of the toilet holding tank 12 in the opposite side of the flush handle 35 and includes a detector 25 and a sensor acting light 25' (FIG. 1). Also, the motion sensor 28 is neither an on/off type switch nor a relay type switch allowing the motion sensor 28 to be more durable the switch of the conventional vent toilet assemblies. Furthermore, since the toilet seat cover 14 disposed on the peripheral inside edge of the seat ring 13 has a small size when compared with the conventional toilet seat cover, the motion sensor 28 is free of interference from the opening and closing of the toilet seat cover 14 (FIG. 1). The motion sensor 28 is connected to the electrical source (not shown) of 12 volts DC. Also, the motion sensor 28 is actuated to operate the fan means 32 while the user sits on the seat ring 13 upon opening the small toilet seat cover 14 and in turn the motion sensor 28 becomes inoperative when the user stands up. Thus, the user is apart from the predetermined area of the motion sensor 28, the motion sensor 28 deactivates. The predetermined area is about 1 foot from the motion sensor 28.

As shown in FIG. 2, the gas exhaust duct 21 disposed between the toilet holding tank 12 and the toilet bowl 27 is connected to and communicates with the ventilation conduit 22. The gas exhaust duct 21 has the raised portion 36 disposed at the bottom portion of the interior surface thereof for preventing the flush water from the water hose 18 from flowing into the ventilation conduit 22. The gas exhaust duct 21, the ventilation conduit 22 and the flush ring 19 communicate to each other so that a kind of sealing system used in the toilet holding tank 12 is not required.

According to the present invention, the toilet assembly 10 operates as follows:

First of all, upon opening the toilet seat cover 14, while the user sits on the seat ring 13, the motion sensor 28 is actuated to operate the fan means 32 and simultaneously the sensor acting light 30 is simultaneously actuated. At this time, the objectionable odor from the toilet bowl 27 through the plurality of openings 20 and the gas exhaust duct 21 is ventilated and discharged to the ventilation conduit 22 and then directly to the sewer line 24 through the annular wide end portion 23. At that time, the gas exhaust duct 21 continuously maintains a vacuum state so that the objectionable odor gas is effectively ventilated.

In turn when the user stands and flushes the toilet assembly 10 by pushing the flush handle 35, the motion sensor 28 is deactivated, the water outlet valve 17 is simultaneously opened and the flush water 26 flows into the toilet bowl 27 from the toilet holding tank 12 through the plurality of openings 20. At this time, simultaneously the flush water 26 effectively discharges the waste product and associated objectionable odor directly to the sewer discharge line 24 through the siphon conduit 25. At that the waste products do not plug up the ventilation conduit 22 since ventilation conduit 22 extends annularly around the siphon conduit 25 at the point where they communicate with the sewer discharge line 24.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A ventilating toilet assembly comprising:

a toilet stool having a toilet bowl, said toilet stool including a back wall portion, a flush ring disposed at the upper end of said toilet bowl, a plurality of openings communicating with said flush ring for allowing flush water to be flushed into the toilet bowl from the flush ring, a seat ring disposed on said flush ring, a toilet seat cover disposed on the peripheral inside edge of said seat ring, and a siphon conduit connected to and communicating with the toilet bowl for discharging waste products directly from the toilet bowl to a sewer discharge line, a ventilation conduit disposed adjacent to said back wall portion of said toilet stool for ventilating objectional odor from the toilet bowl, said ventilation conduit extending annularly around said siphon conduit at a point where they communicate with said sewer discharge line, said ventilation conduit containing a fan disposed in the lower portion thereof, a toilet holding tank for containing flush water, said toilet holding tank having a water intake valve and an opening leading to said toilet bowl, a motion sensor disposed on the front exterior of said toilet holding tank facing said toilet stool, said motion sensor being free of interference from the opening and closing of the toilet seat cover, and a gas exhaust duct disposed between said toilet holding tank and said toilet bowl, said gas exhaust duct connected to and communicating with said ventilation conduit wherein the gas exhaust duct has a raised portion disposed at the interior surface thereof for allowing exhaust gas to flow from the flush ring to the ventilation conduit, said raised portion being provided with a water exiting tube disposed under the raised portion for preventing flush water from said water exiting tube from flowing into the ventilation conduit, whereby with the toilet seat cover open, while the user sits on the seat ring, the motion sensor actuates the fan allowing the objectionable odor to be ventilated, and in turn when the user stands up and flushes the toilet assembly, the motion sensor is deactivated and simultaneously, the flush water discharges the waste products and associated objectionable odor directly to the sewer discharge line.

2. The ventilating toilet assembly of claim 1, wherein the fan contains a water-proof fan motor.

3. The ventilating toilet assembly of claim 1, wherein the motion sensor contains a detector and sensor acting light and is connected to the electrical source of 12 volts, DC.

4. The ventilating toilet assembly of claim 3, wherein the motion sensor is automatically deactivated when the user reaches the outside of a predetermined area thereof.

5. The ventilating toilet assembly of claim 4, wherein the predetermined area is about 1 foot from the motion sensor.

* * * * *